US008544649B2

(12) United States Patent
Rivera et al.

(10) Patent No.: US 8,544,649 B2
(45) **Date of Patent: *Oct. 1, 2013**

(54) STACKABLE CONTAINERS AND METHODS OF MANUFACTURING, STACKING, AND SHIPPING THE SAME

(75) Inventors: Benedict R. Rivera, Powder Springs, GA (US); Richard Longbottom, Seekonk, MA (US)

(73) Assignee: Consolidated Container Company LP, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/881,743

(22) Filed: Sep. 14, 2010

(65) Prior Publication Data

US 2010/0326872 A1 Dec. 30, 2010

Related U.S. Application Data

(60) Continuation of application No. 12/762,803, filed on Apr. 19, 2010, which is a division of application No. 11/284,696, filed on Nov. 21, 2005, now Pat. No. 7,699,171.

(60) Provisional application No. 60/629,780, filed on Nov. 20, 2004.

(51) Int. Cl.
*B65D 21/032* (2006.01)

(52) U.S. Cl.
USPC ..... 206/508; 220/23.83; 215/10

(58) Field of Classification Search
USPC ..... 215/10, 383, 382; 206/504; 220/23.6, 220/23.2; D9/745, 743, 741, 738
IPC ..... B65D 21/036, 21/032, 21/02, 21/00
See application file for complete search history.

(56) References Cited

U.S. PATENT DOCUMENTS

| | | | |
|---|---|---|---|
| 255,900 | A | 4/1882 | Thorpe |
| 353,600 | A | 11/1886 | Sloan |
| 1,190,203 | A | 7/1916 | Sorge, Jr. |
| 2,077,027 | A | 4/1937 | Torras |

(Continued)

FOREIGN PATENT DOCUMENTS

| | | | |
|---|---|---|---|
| EP | 0 205 135 | A1 | 12/1986 |
| EP | 0 354 083 | A1 | 2/1990 |

OTHER PUBLICATIONS

Office Action dated May 16, 2011 of U.S. Appl. No. 12/762,803, filed Apr. 19, 2010.

(Continued)

*Primary Examiner* — Robert J Hicks

(74) *Attorney, Agent, or Firm* — Alston & Bird LLP

(57) ABSTRACT

Stackable containers that, in various embodiments, are adapted to be vertically and/or horizontally interlocked with other, like, containers to, for example, increase the stability of stacks of the containers. In one embodiment, a stackable container comprises: (A) a top surface comprising a shoulder portion that extends upwardly from the top surface and that is substantially disposed within a perimeter defined by the top surface; (B) a bottom surface defining a stacking recess; (C) a plurality of substantially vertical side surfaces that extend between the top surface and the bottom surface. In various embodiments, a recessed portion of the bottom surface adjacent the stacking recess is adapted to substantially mate with at least a portion of a shoulder portion of a like container.

20 Claims, 16 Drawing Sheets

(56) References Cited

U.S. PATENT DOCUMENTS

| | | | | |
|---|---|---|---|---|
| 2,488,611 | A * | 11/1949 | Stallings | 215/10 |
| 2,641,374 | A | 6/1953 | Der Yuen | |
| D189,372 | S | 11/1960 | Adell | |
| 2,960,248 | A * | 11/1960 | Kuhlman | 215/10 |
| D199,203 | S | 9/1964 | Dailey | |
| 3,194,426 | A | 7/1965 | Brown, Jr. | |
| D203,226 | S | 12/1965 | Schnur et al. | |
| 3,323,668 | A | 6/1967 | Hills | |
| 3,338,404 | A | 8/1967 | Becker et al. | |
| 3,369,658 | A | 2/1968 | Hasselmann | |
| 3,369,688 | A | 2/1968 | Dike | |
| 3,391,824 | A | 7/1968 | Wiseman | |
| 3,397,724 | A | 8/1968 | Bolen et al. | |
| 3,491,505 | A | 1/1970 | Hasselmann | |
| 3,529,717 | A | 9/1970 | McDougal | |
| 3,542,193 | A | 11/1970 | Hewlett et al. | |
| 3,561,188 | A | 2/1971 | Cleland | |
| 3,612,299 | A | 10/1971 | Shaw et al. | |
| 3,708,082 | A | 1/1973 | Platte | |
| 3,765,574 | A | 10/1973 | Urquiza | |
| 3,788,463 | A | 1/1974 | Ruff | |
| 3,855,756 | A | 12/1974 | Sweeney et al. | |
| 3,889,834 | A | 6/1975 | Harris, Jr. | |
| 4,036,362 | A | 7/1977 | Ullman | |
| 4,133,445 | A | 1/1979 | Mandelbaum | |
| 4,165,812 | A | 8/1979 | Jennison | |
| 4,170,082 | A | 10/1979 | Freedman | |
| 4,300,681 | A | 11/1981 | Klygis et al. | |
| 4,308,955 | A | 1/1982 | Schieser et al. | |
| 4,351,454 | A | 9/1982 | Maynard, Jr. | |
| 4,416,373 | A | 11/1983 | deLarosiere | |
| 4,509,639 | A | 4/1985 | Thompson | |
| 4,565,043 | A | 1/1986 | Mazzarese | |
| 4,570,799 | A | 2/1986 | Mednis | |
| 4,589,560 | A | 5/1986 | Harris, Jr. | |
| 4,609,106 | A | 9/1986 | Gentili | |
| 4,624,383 | A | 11/1986 | Moore | |
| 4,655,028 | A | 4/1987 | Silbernagel | |
| 4,685,565 | A | 8/1987 | Sparling | |
| 4,691,828 | A | 9/1987 | Slusarczyk et al. | |
| 4,708,253 | A | 11/1987 | Mednis | |
| 4,805,793 | A | 2/1989 | Brandt et al. | |
| 4,838,450 | A | 6/1989 | Bocchi | |
| D307,389 | S | 4/1990 | Larson | |
| 4,919,270 | A | 4/1990 | Govang et al. | |
| 5,002,199 | A | 3/1991 | Frahm | |
| 5,048,687 | A | 9/1991 | Suzuki et al. | |
| 5,064,101 | A | 11/1991 | Richter et al. | |
| 5,119,972 | A | 6/1992 | Reed et al. | |
| 5,133,469 | A | 7/1992 | Mehta et al. | |
| 5,217,128 | A | 6/1993 | Stenger | |
| 5,299,710 | A | 4/1994 | Weisch et al. | |
| 5,307,609 | A | 5/1994 | Kurata et al. | |
| 5,312,011 | A | 5/1994 | Fischer | |
| 5,316,159 | A | 5/1994 | Douglas et al. | |
| 5,330,050 | A | 7/1994 | Stansbury, Jr. et al. | |
| 5,409,128 | A | 4/1995 | Mitchell | |
| 5,425,219 | A | 6/1995 | Tanaka et al. | |
| 5,447,249 | A | 9/1995 | Vickers | |
| 5,535,910 | A | 7/1996 | Cassel | |
| 5,573,133 | A | 11/1996 | Park | |
| 5,697,500 | A | 12/1997 | Walker | |
| 5,699,925 | A | 12/1997 | Petruzzi | |
| 5,779,051 | A | 7/1998 | Boutin | |
| 5,782,358 | A | 7/1998 | Walker | |
| 5,833,115 | A | 11/1998 | Eiten | |
| 5,866,419 | A | 2/1999 | Meder | |
| D407,020 | S | 3/1999 | Doty | |
| 5,887,740 | A | 3/1999 | Hong | |
| 5,927,499 | A | 7/1999 | Vesborg | |
| 5,938,011 | A | 8/1999 | Holzapfel et al. | |
| D417,621 | S | 12/1999 | Hofmeister et al. | |
| 6,050,455 | A | 4/2000 | Soehnlen et al. | |
| 6,053,345 | A | 4/2000 | Jones | |
| 6,082,541 | A | 7/2000 | Bewick | |
| 6,095,332 | A | 8/2000 | Finand et al. | |
| 6,105,776 | A | 8/2000 | Meilhon | |
| 6,123,196 | A | 9/2000 | Chiu | |
| 6,145,656 | A | 11/2000 | Marco | |
| 6,202,881 | B1 | 3/2001 | Chiang | |
| 6,223,942 | B1 | 5/2001 | Markey et al. | |
| 6,230,892 | B1 | 5/2001 | Przytulla et al. | |
| 6,276,549 | B1 | 8/2001 | Fasci et al. | |
| 6,325,212 | B2 | 12/2001 | Przytulla et al. | |
| 6,367,631 | B1 | 4/2002 | Steigerwald | |
| 6,419,783 | B1 | 7/2002 | Rainey et al. | |
| 6,497,333 | B1 | 12/2002 | Ellis et al. | |
| 6,527,133 | B1 | 3/2003 | McCollum et al. | |
| 6,588,612 | B1 | 7/2003 | Dorn et al. | |
| D489,271 | S | 5/2004 | Soomar | |
| 6,772,898 | B1 | 8/2004 | Florino et al. | |
| 6,857,530 | B2 | 2/2005 | Yourist | |
| 6,932,228 | B1 | 8/2005 | Darr et al. | |
| 7,699,171 | B2 | 4/2010 | Rivera et al. | |
| 2001/0025800 | A1 | 10/2001 | Marco | |
| 2003/0010743 | A1 | 1/2003 | Boukobza | |
| 2003/0132184 | A1 | 7/2003 | Dorn et al. | |
| 2003/0196926 | A1 | 10/2003 | Tobias et al. | |
| 2003/0221987 | A1 | 12/2003 | Trude | |
| 2003/0234200 | A1 | 12/2003 | Diamant | |
| 2004/0116037 | A1 * | 6/2004 | Garpow | 446/74 |
| 2004/0178161 | A1 | 9/2004 | Galustyan | |
| 2004/0262308 | A1 | 12/2004 | Hase | |
| 2006/0000740 | A1 | 1/2006 | Sigur | |
| 2006/0011574 | A1 | 1/2006 | Itokawa et al. | |
| 2006/0049127 | A1 | 3/2006 | Katz et al. | |
| 2006/0096942 | A1 * | 5/2006 | Lane | 215/10 |
| 2006/0118456 | A1 | 6/2006 | Macasaet et al. | |

OTHER PUBLICATIONS

Office Action dated May 20, 2008 of U.S. Appl. No. 11/284,696, filed Nov. 21, 2005.

Office Action dated Aug. 20, 2008 of U.S. Appl. No. 11/284,696, filed Nov. 21, 2005.

Final Office Action dated Jan. 9, 2009 of U.S. Appl. No. 11/284,696, filed Nov. 21, 2005.

Notice of Allowance dated Nov. 30, 2009 of U.S. Appl. No. 11/284,696, filed Nov. 21, 2005.

Office Action dated Dec. 27, 2010 of U.S. Appl. No. 12/762,803, filed Apr. 19, 2010.

* cited by examiner

STACKABLE CONTAINERS AND METHODS OF MANUFACTURING, STACKING, AND SHIPPING THE SAME

CROSS-REFERENCE TO RELATED APPLICATIONS

This application is a continuation application of U.S. Nonprovisional Application No. 12/762,803 entitled "Stackable Containers and Methods of Manufacturing, Stacking, and Shipping Same," filed on Apr. 19, 2010, which claims priority from U.S. Nonprovisional Application No. 11/284,696 entitled "Stackable Containers and Methods of Manufacturing, Stacking, and Shipping Same," filed on Nov. 21, 2005, which in turn claims priority from U.S. Provisional Application No. 60/629,780 entitled "Stackable Containers and Methods of Manufacturing, Stacking, and Shipping Same," filed on Nov. 20, 2004, all of which are hereby incorporated herein by reference.

BACKGROUND OF THE INVENTION

In the past, container distributors have packaged irregularly shaped containers in boxes for shipping the containers because the containers could not be stacked and shipped safely on pallets, for example. However, the process of packing the containers into boxes can be costly and time consuming. Thus, there is a need in the art for a more cost-and time-effective method of shipping irregularly-shaped containers.

BRIEF SUMMARY OF THE INVENTION

A stackable container according to various embodiments of the invention includes a plurality of substantially vertical side surfaces that are integrally formed with and extend between a top surface and a bottom surface. The top surface extends between the substantially vertical side surfaces and includes a shoulder portion. The shoulder portion extends upwardly from the top surface and is substantially disposed within the perimeter of the top surface. The bottom surface extends between the substantially vertical side surfaces and defines a stacking recess. The stacking recess extends upwardly from the bottom surface toward an interior of the container defined by the substantially vertical side surfaces. The stacking recess is disposed within a perimeter of the bottom surface such that a surface of the stacking recess is adapted to substantially mate with at least a portion of the shoulder portion of a vertically adjacent container that has substantially the same structure. In a further embodiment, the interface between the top surface and the shoulder portion defines a lip, and the interface between the bottom surface and the stacking recess defines an interface recess. The interface recess is adapted to substantially mate with the lip of the adjacent container.

In one embodiment of the invention, the container further includes a plurality of substantially vertical ribs that extend outwardly from the substantially vertical side surfaces and a plurality of substantially vertical grooves that extend inwardly from the substantially vertical side surfaces. Each of the vertical grooves is adapted to engage one of the substantially vertical ribs of a horizontally adjacent container that has substantially the same structure as the first container.

According to one embodiment of the invention, a method of stacking a plurality of stackable containers is provided that includes the steps of: (1) grouping stackable containers into pairs; (2) wrapping each grouped pair of stackable containers with a first flexible material; (3) positioning a first layer of wrapped stackable containers on a pallet; (4) after the first layer of wrapped stackable containers is positioned on the pallet, stacking a second layer of wrapped stackable containers on top of the first layer; and (5) after the second layer of wrapped stackable containers is positioned on the pallet, wrapping the first and second layers of wrapped stacked containers with a second flexible material having a perforation line. In one embodiment, the second flexible material is wrapped around the first and second layers of wrapped stacked containers such that the perforation line substantially coincides with an interface between the top portions of the wrapped stackable containers in the first layer and the bottom portions of the wrapped stackable container in the second layer.

According to one embodiment of the invention, the method of stacking a plurality of stackable containers further includes the step of removing a top portion of the second flexible material, wherein the top portion is above the perforation line of the second flexible material, by pulling the top portion of the second flexible material away from the plurality of stacked containers.

BRIEF DESCRIPTION OF THE SEVERAL VIEWS OF THE DRAWINGS

In the disclosure below, reference will be made to the accompanying drawings, which are not necessarily drawn to scale, and wherein.

DETAILED DESCRIPTION OF THE INVENTION

Figure 1:
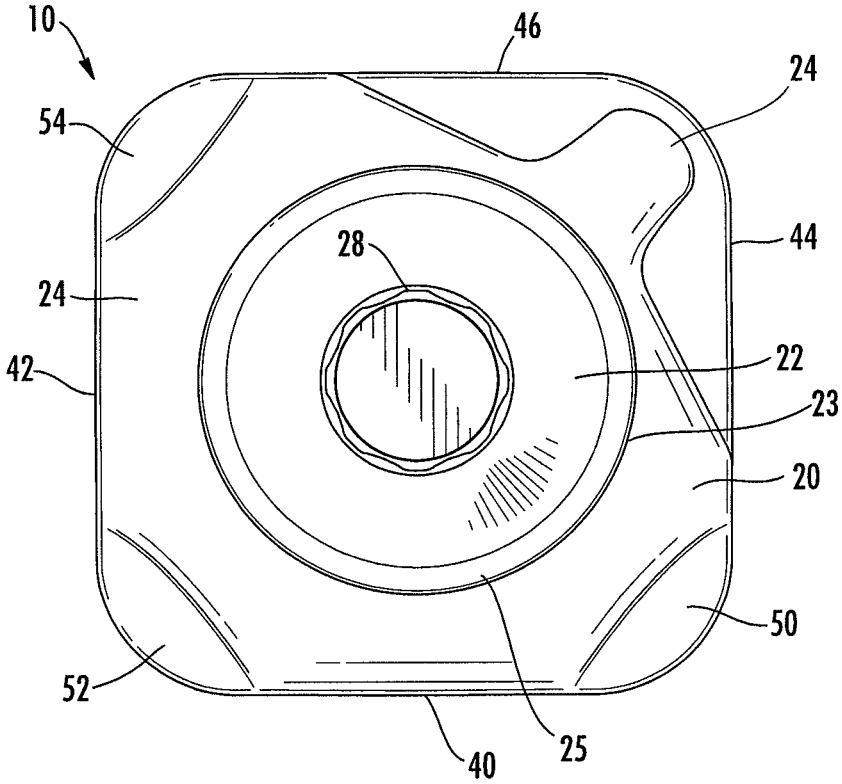
FIG. 1 is a top view of a stackable container according to one embodiment of the present invention.
Figure 2:
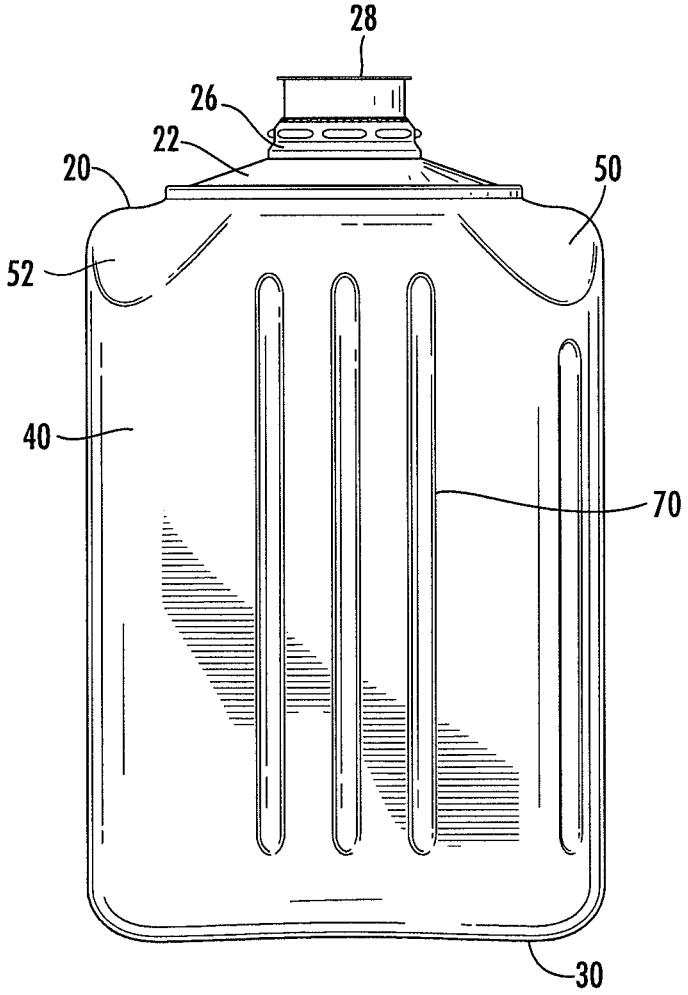
FIG. 2 is a view of a first front side surface of the stackable container of FIG. 1.

This disclosure describes various embodiments of a stackable container, and related manufacturing and shipping methods. The present inventions are described below with reference to the accompanying drawings, in which some, but not all embodiments of the inventions are shown. Indeed, these inventions may be embodied in many different forms and should not be construed as limited to the embodiments set forth herein. Rather, these embodiments are provided so that this disclosure will satisfy applicable legal requirements. Like numbers refer to like elements throughout.

Overview

The present invention relates, in various embodiments, to a plastic stackable container that can be used, for example, to store, transport and display a product such as milk or water to consumers. Specifically, stackable containers according to certain embodiments of the present invention are adapted to be vertically and/or horizontally interlocked with other like containers to increase the stability of stacks of the containers. In certain embodiments, this allows the containers to be stacked higher than prior art containers. Also, in various embodiments of the invention, the interlocking nature of the containers allows the containers to be stacked without providing a slip sheet of corrugate between the various vertical layers of containers. However, in other embodiments of the invention, slip sheets may be provided between the various vertical stacked layers of containers.

Structure of Various Embodiments of the Invention

The structure of a stackable container 10 according to one embodiment of the invention is shown in FIGS. 1-5. As may be understood from these figures, in this embodiment, the stackable container 10 includes a top surface 20, a bottom surface 30, and various side surfaces 40, 42, 44, 46. The terms "top" and "bottom" are used to describe relative surfaces of the container 10 when the container 10 is in an upright position, but they should not be interpreted to limit the orientation of the containers. In various embodiments of the invention, at least part of one or more, and preferably all of the side surfaces 40, 42, 44, 46 extends between the container's top and bottom surfaces 20, 30. In the embodiment of the invention shown in FIGS. 1-5, which has a substantially square lower horizontal cross section, the side surfaces include a first front side surface 40, a second front side surface 42, a first rear side surface 44, and a second rear side surface 46.

Top Surface

Figure 3:
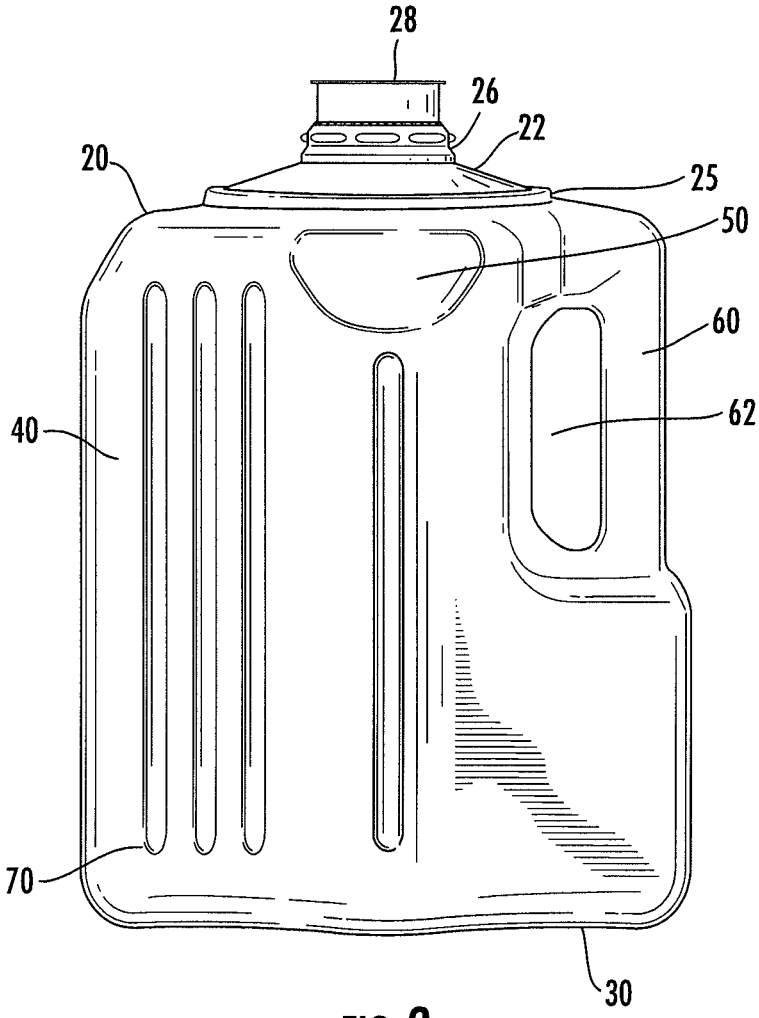
FIG. 3 is a perspective side corner view of the stackable container of FIG. 1 showing the first front side surface and the first rear side surface of the stackable container of FIG. 1.
Figure 4:
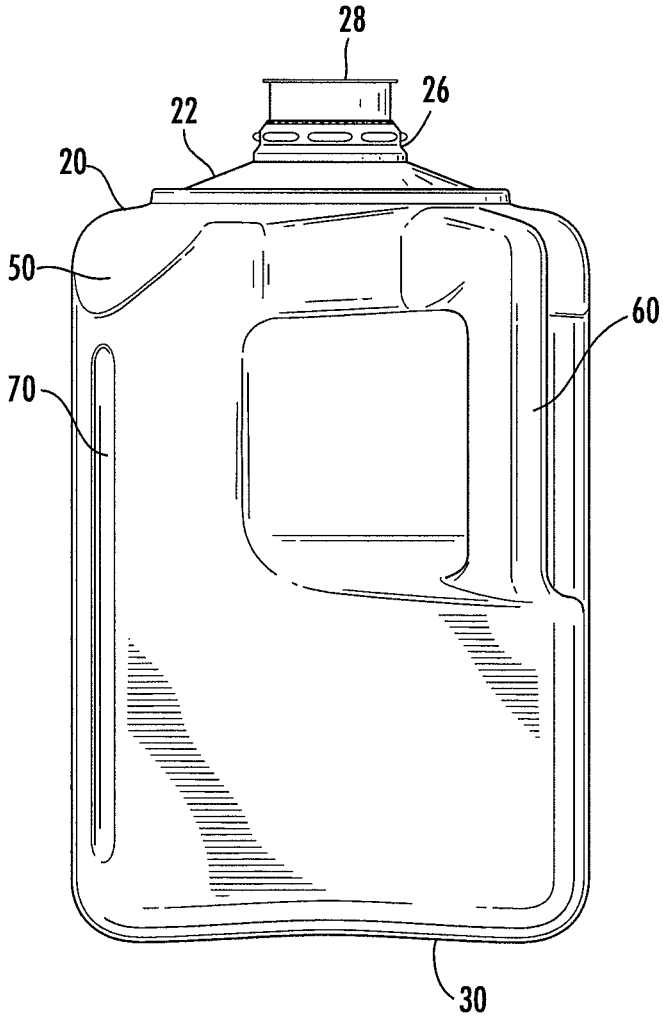
FIG. 4 is a view of the first rear side surface of the stackable container of FIG. 1.

As may be understood from FIGS. 1, 3, and 4, in one embodiment, the container's top surface 20 comprises a shoulder portion 22 and a neck portion 26. According to one embodiment, the shoulder portion 22 extends upwardly from the top surface 20 (e.g., away from the interior of the container) and defines a perimeter 23 (e.g., a substantially circular perimeter). The neck portion 26 is disposed within the shoulder portion's perimeter 23 and extends upwardly from the shoulder portion 22 (e.g., away from the interior of the container). In a particular embodiment of the invention, the neck portion 26 has a substantially circular horizontal cross section. In certain embodiments of the invention, the shoulder portion 26 is substantially conical in shape.

In various embodiments of the invention, the container's shoulder portion 22 is substantially centered within a perimeter defined by a portion of the container (e.g., a perimeter defined by the container's top surface 20 or bottom surface 30). Similarly, in a particular embodiment of the invention, the container's neck portion 26 is substantially centered within a perimeter defined by a portion of the container (e.g., the perimeter of the container's top surface 20, bottom surface 30, or shoulder portion 22). In one embodiment of the invention, such as the embodiment shown in FIG. 1, the container's neck portion 26 is substantially centered within the perimeter of the container's shoulder portion 22.

In a particular embodiment of the invention, the container's neck portion 26 defines an outlet opening (not shown) through which liquid may be transferred into and/or out of an interior portion of the container 10. In a particular embodiment, the neck portion 26 is a center-filled neck portion. In one embodiment of the invention, the container 10 includes a removable cap 28 for selectively opening and closing the container's outlet opening.

In one embodiment of the invention, the shoulder portion 22 further defines one or more grooves 24 that extend from a perimeter defined by the neck portion 26 (or adjacent thereto) in a radially outward direction toward the perimeter of the shoulder portion 22. In one embodiment, the grooves 24 increase the top load strength of the container 10.

As may be understood from FIGS. 1 and 3, in one embodiment of the invention, one or more top corner surfaces 50, 52, 54 are defined at the intersections of the top surface 20 and two substantially vertical side surfaces 40, 42, 44, 46. The top corner surface 50, 52, 54 may include a slope (e.g., a diagonal slope), and the top corner surfaces 50, 52, 54 may have, for example, a triangular-shaped surface. However, alternative embodiments of the invention may or may not include this feature.

Handle

As may be understood from FIGS. 1 and 3, in one embodiment of the invention, the top portion of the container 10 has a substantially triangular horizontal cross section, and the container 10 further includes a handle 60 opposite the front apex of the triangular cross section. In one embodiment of the invention, the handle 60 defines a four-finger handle size opening 62 to facilitate carrying the container 10 and pouring its contents. In a particular embodiment, the handle 60 extends between the container's top surface 20 and the top surface of the container's lower portion, which, as noted below, may have a substantially square horizontal cross section.

Bottom Surface

Figure 5:
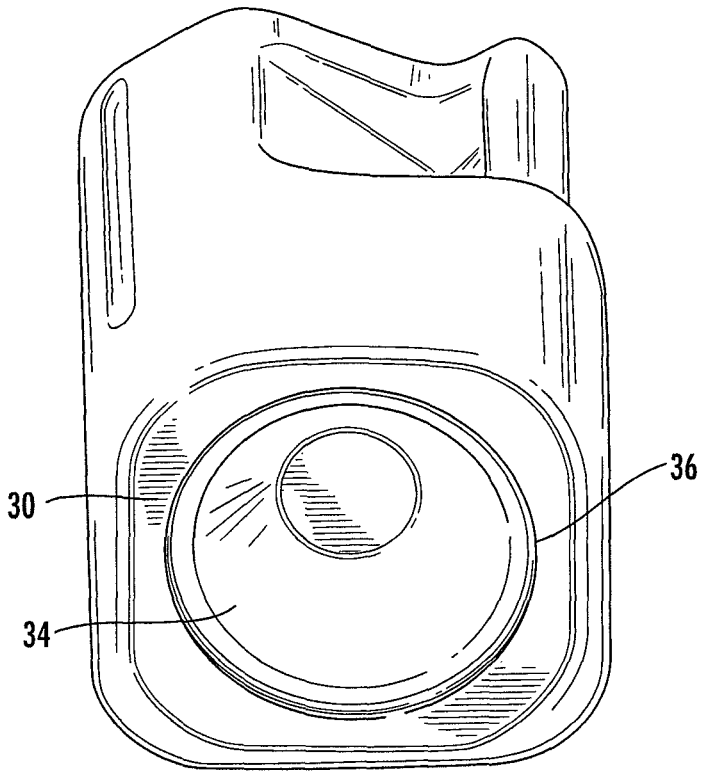
FIG. 5 is a perspective bottom view of the stackable container of FIG. 1.
Figure 6:
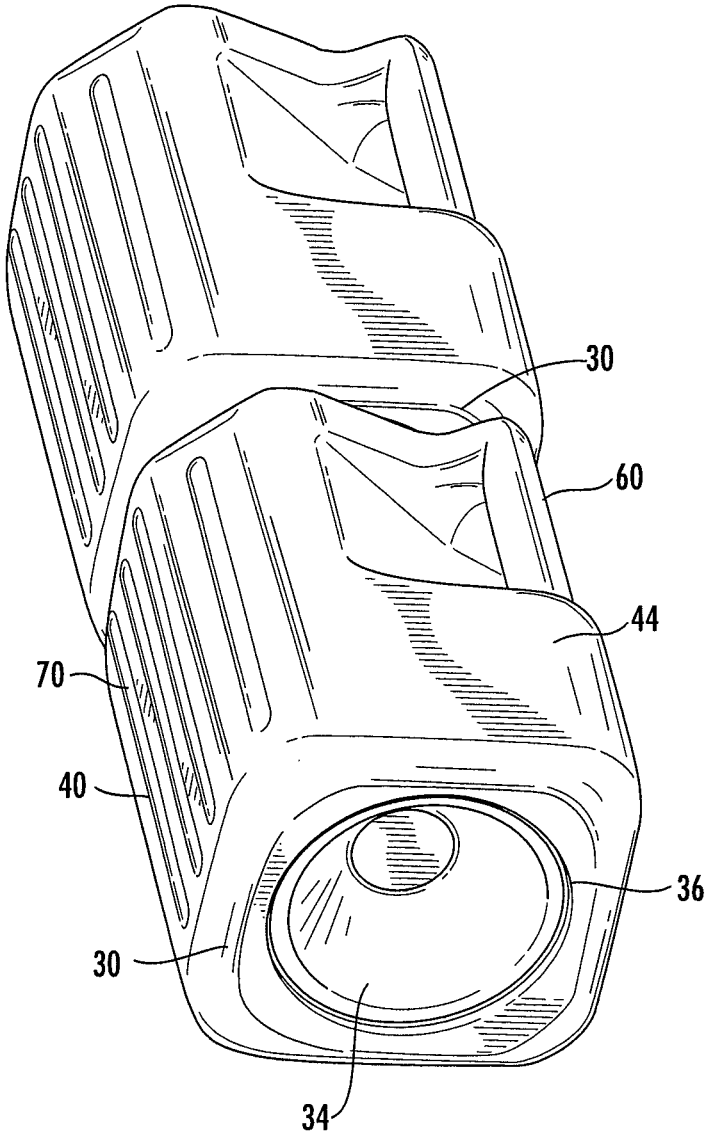
FIGS. 6 and 7 are perspective views of two stackable containers that are stacked on top of one another in accordance with one embodiment of the present invention.
Figure 7:
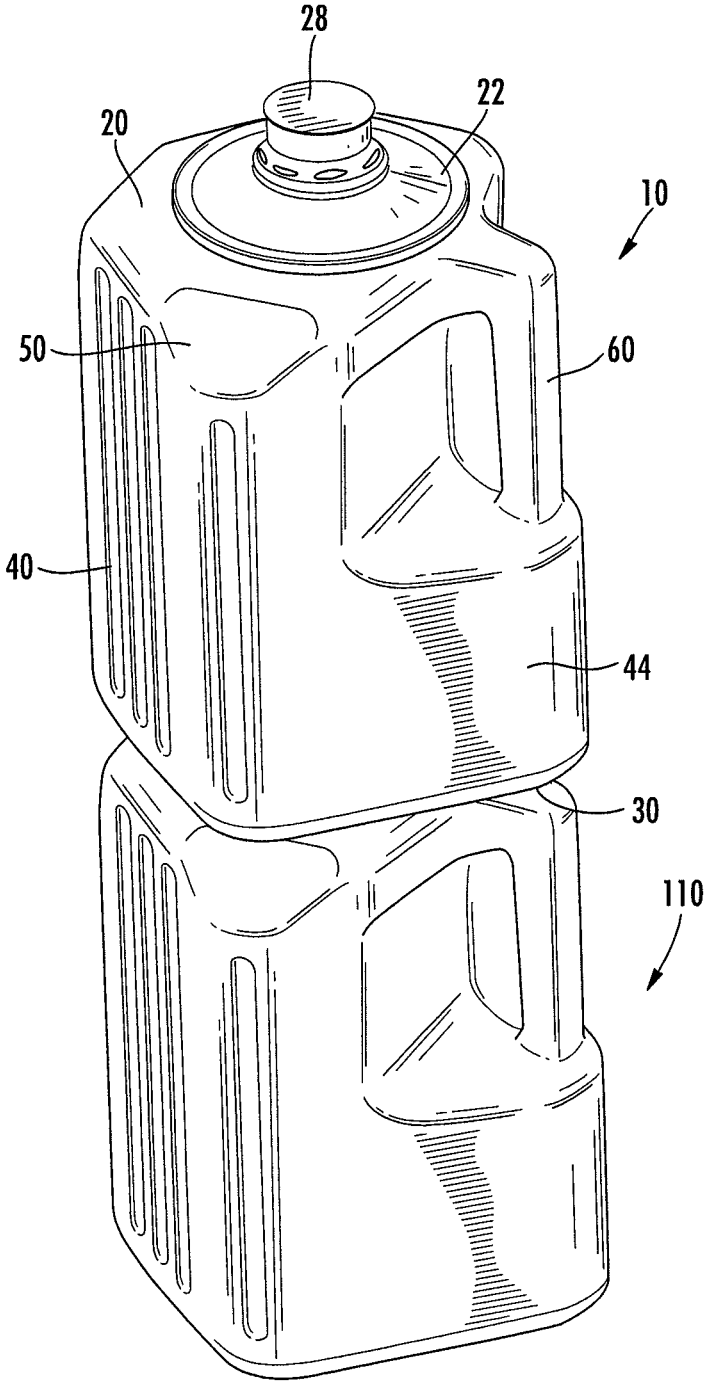

As may be understood from FIG. 5, in one embodiment of the invention, the bottom surface 30 of the stackable container 10 defines a stacking recess 34 that extends upwardly toward the interior of the container 10. In various embodiments of the invention, the stacking recess 34 defines a perimeter that substantially corresponds, in size and/or shape, to the perimeter 23 of the container's shoulder portion 22. In a particular embodiment of the invention, the stacking recess 34 is substantially centered within a perimeter defined by a portion of the container (e.g., the perimeter of the container's top surface 20 or bottom surface 30). For example, in the embodiment shown in FIG. 5, the stacking recess 34 is substantially centered within the perimeter of the container's bottom surface 30. In a particular embodiment of the invention, the stacking recess 34 (or at least a portion of the stacking recess 34) is substantially conical in shape.

Figure 8:
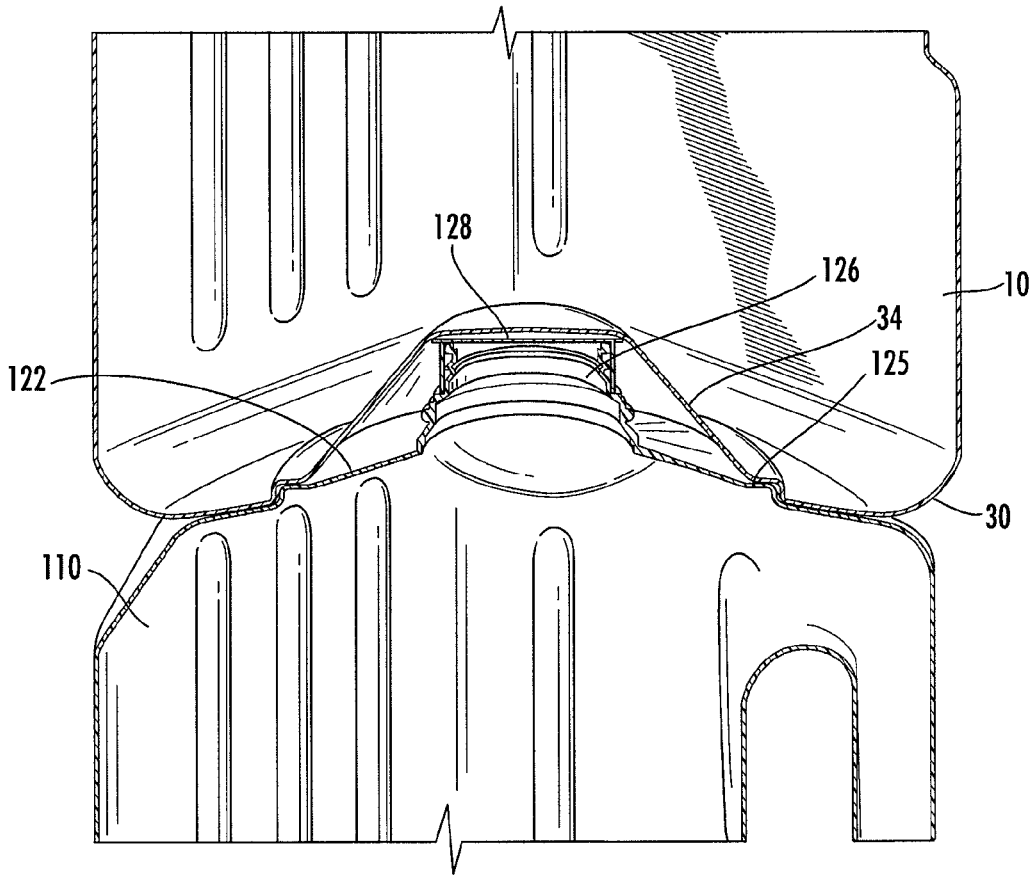
FIGS. 8 and 9 are cross-sectional views of the interface between the two stackable containers shown in FIGS. 6 and 7.
Figure 9:
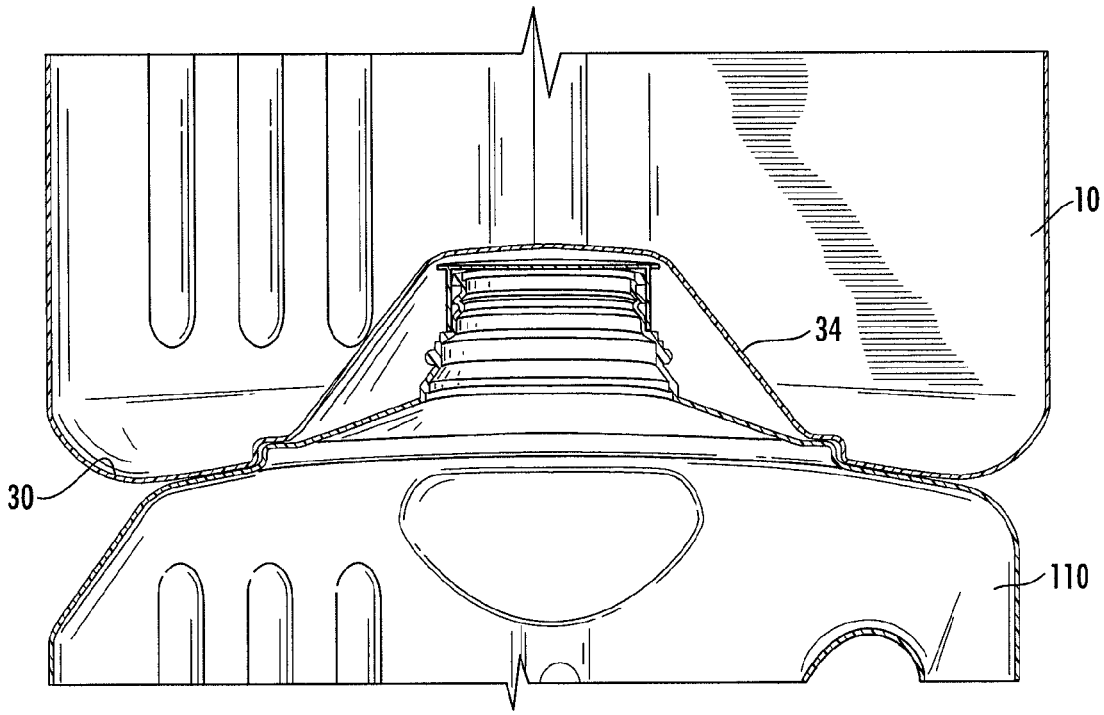

As may be understood from FIGS. 8 and 9, in a particular embodiment of the invention, at least a portion of the surface of the stacking recess 34 is adapted to substantially mate with a corresponding portion of a corresponding bottom container's shoulder portion 122. (In one embodiment of the invention, the container and "the corresponding bottom container" have substantially the same structure, e.g., the structure shown in FIGS. 1-5.) For example, in a particular embodiment of the invention, the stacking recess 34 includes a container interface recess 36 that is adapted to substantially mate with a container interface lip 125 formed by the corresponding bottom container's shoulder portion 122. In one embodiment of the invention, this container interface lip 125 is disposed adjacent the perimeter of the corresponding bottom container's shoulder portion 122.

In a particular embodiment of the invention, at least a portion of both the container interface lip 25, 125 and the container interface recess 36 is substantially in the form of an arc, and the container interface recess 36 is adapted to substantially mate with the corresponding bottom container's container interface lip 125 along substantially the entire length of the arc. In a particular embodiment of the invention, this arc is greater than about 0.5 inches. In other embodiments of the invention, this arc is between about 0.5 and 6 inches in length.

In a particular embodiment of the invention, the container interface lip 125 and the container interface recess 36 are substantially in the form of a circle. Also, in one embodiment of the invention (e.g., the embodiment shown in FIG. 9), the container interface lip 125 and the container interface recess 36 are adapted to substantially mate along substantially the entire length of the container interface lip 125. In various other embodiments of the invention, the container interface lip 125 and the container interface recess 36 are adapted to substantially mate along: (1) between about 40%-50% of the interface lip 125; (2) between about 50%-60% of the interface lip 125; (3) between about 70%-80% of the interface lip 125; (4) between about 80%-90% of the interface lip 125; (5) between about 90%-100% of the interface lip 125.

As may be understood from FIG. 9, in one embodiment of the invention, the stacking recess 34 is dimensioned so that when a portion of the container 10 is interlockingly stacked on a corresponding bottom container 110 (e.g., where both containers have substantially the same structure), the neck portion 126 of the corresponding bottom container 110 is received within the container's stacking recess 34. In various embodiments, this may prevent damage to the neck 126 of the corresponding bottom container 110 when the container 10 and the corresponding bottom container 110 are interlocked (e.g., during shipment, storage, and/or display).

In one embodiment of the invention, the container's stacking recess 34 is dimensioned so that the corresponding bottom container's neck portion 126 does not substantially engage an interior portion of the container's stacking recess 34 when the container 10 is interlockingly stacked on the corresponding bottom container 110. This allows substantially the entire weight of the container 10 to be supported by other portions of the corresponding bottom container 110 than the corresponding bottom container's neck portion 126 and/or cap portion 128. In a particular embodiment of the invention, at least a portion of the container's stacking recess 34 is about 1.75 to about 2 inches deep.

In one embodiment of the invention, the container 10 is adapted so that when a container 10 is interlockingly stacked on top of a corresponding bottom container 110, substantially all of the weight of the container 10 is supported by the shoulder portion 122 of the corresponding bottom container 110. In a particular embodiment of the invention, the container 10 is adapted so that substantially all of the weight of the container 10 is supported adjacent the perimeter 123 of the corresponding bottom container's shoulder portion 122. In one embodiment, the container 10 is adapted so that substantially all of the weight of the container 10 is supported adjacent the corresponding bottom container's interface lip 125. As noted above, this interface lip 125 may be, for example, substantially circular.

In an alternative embodiment of the invention, the container's stacking recess 34 is dimensioned so that the neck portion 126 of the corresponding bottom container 110 engages at least a portion of the surface of the stacking recess 34 when the container 10 is interlockingly stacked on the corresponding bottom container 110. This allows the corresponding bottom container's neck portion 126 to share some of the load of the container 10.

Figure 15:
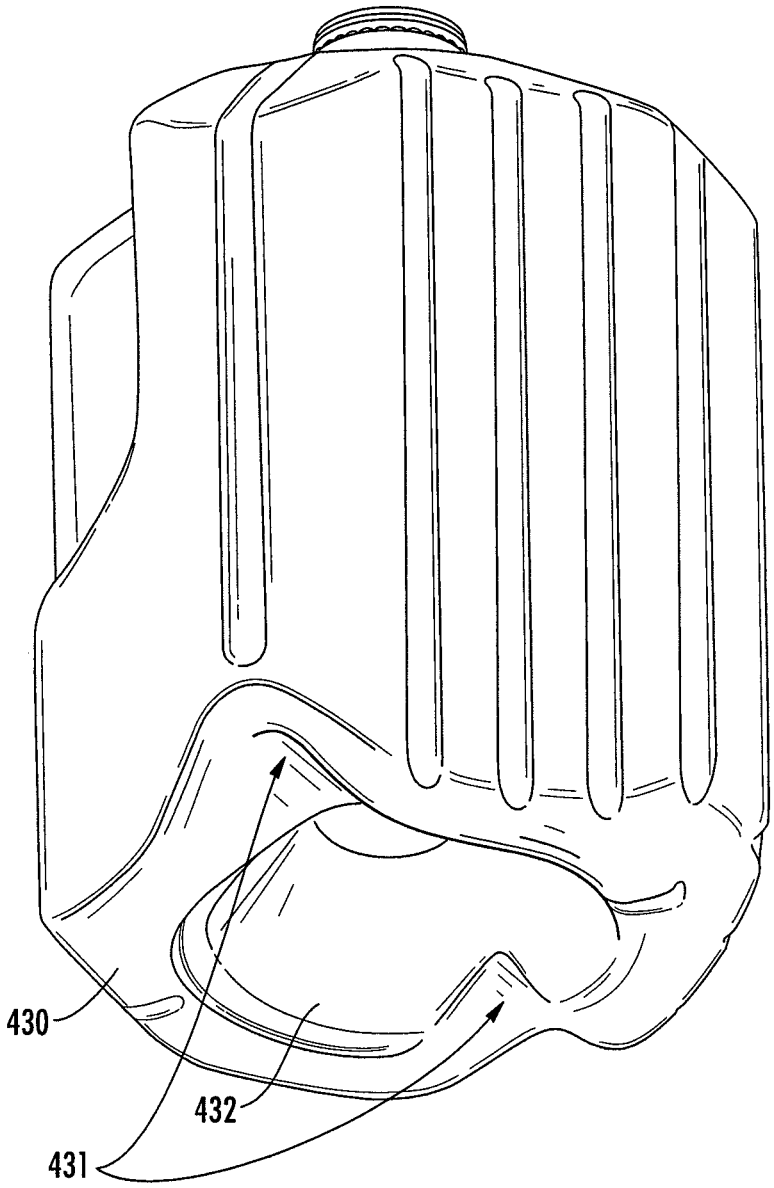
FIG. 15 is a perspective bottom view of a stackable container in accordance with yet another embodiment of the invention.

In various embodiments of the invention (e.g. the embodiment shown in FIG. 15), the bottom surface 430 further defines a pair of recesses 431. Each recess 431 extends from the perimeter of the stacked recess 432 to the perimeter of the bottom surface 430. In one embodiment, the recesses 431 are disposed adjacent two opposing corners defined by the intersection of two side surfaces 440, 442, 444, 446 of the container.

Side Surfaces

As may be understood from FIG. 3, in various embodiments of the invention, one or more of the container's various side surfaces 40, 42, 44, 46 may define one or more grooves 70 (e.g., substantially vertical grooves). The grooves may, for example, serve to enhance the strength of the container 10.

In addition, in various embodiments of the invention, one or more of the container's various side surfaces 40, 42, 44, 46 may define one or more ribs (not shown) that are adapted to substantially mate with at least a portion of a groove 70 within a side surface 40, 42, 44, 46 of a corresponding like container (e.g., that is positioned next to the container 10). This may provide lateral support for the containers 10 when the containers 10 are stacked as described herein, and in one embodiment, engaging at least one of the ribs with one of the grooves 70 may prevent horizontal movement of containers that are stacked horizontally adjacent to each other.

Figure 14A:
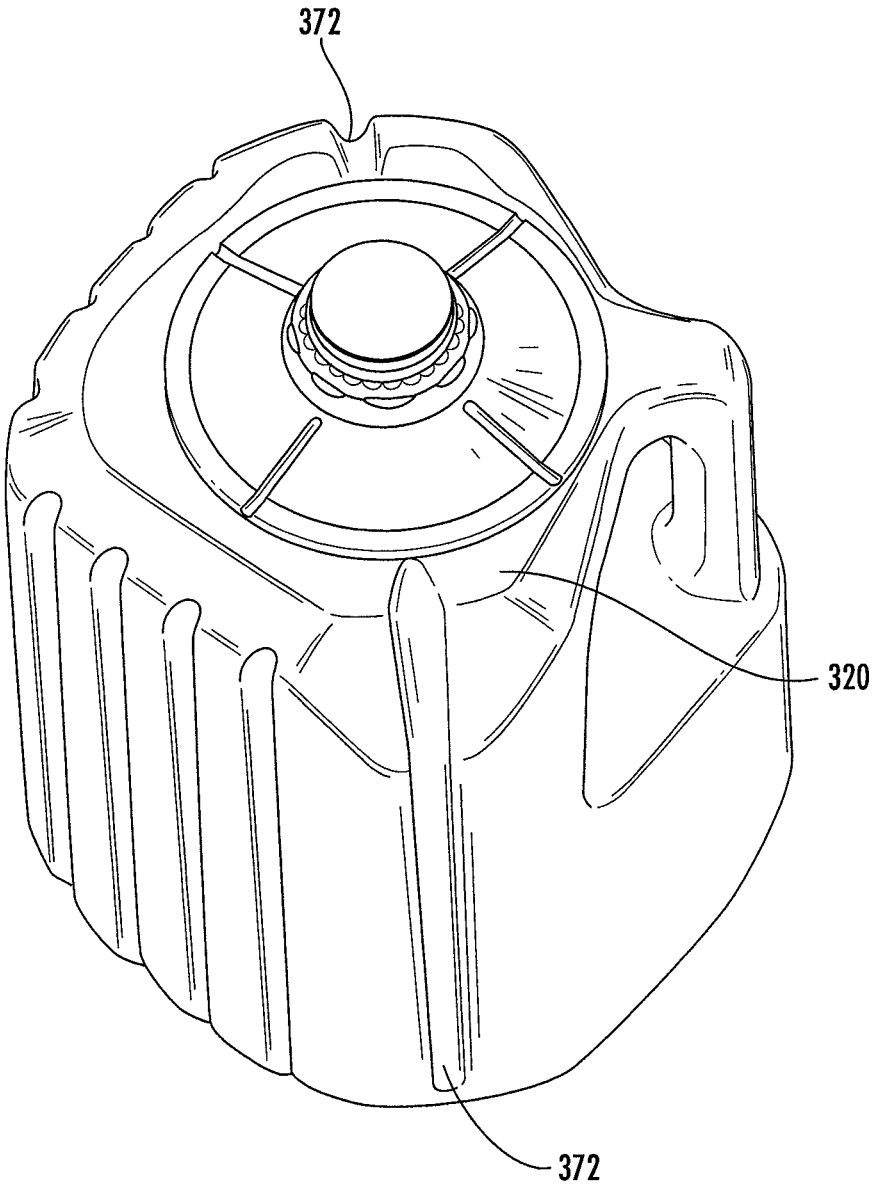
FIG. 14A is a perspective top view of the stackable container shown in FIG. 13.
Figure 14B:
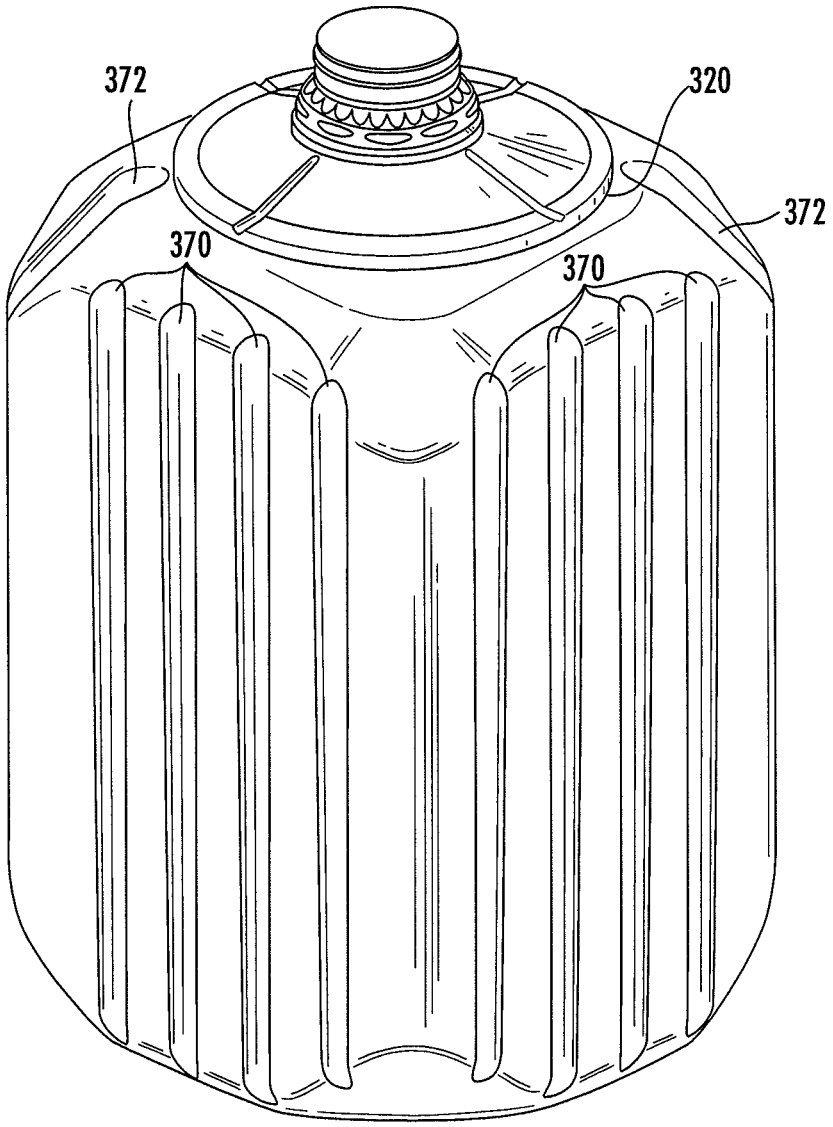
FIG. 14B is a perspective side view of the stackable container shown in FIG. 13.

In another embodiment, at least one of the grooves 70 extends in a substantially vertical direction from the top surface 20 to the bottom surface 30. In one embodiment (e.g., the embodiment shown in FIGS. 14A and 14B), at least one of the grooves 370 extends from a chamfered surface extending between a substantially vertical side surface 340, 342, 344, 346 and the top surface 320 to a chamfered surface extending between a substantially vertical side surface 340, 342, 344, 346 and the bottom surface 330.

In addition to the grooves 370 defined in the side surfaces 340, 342, 344, 346, a container 310 according to one embodiment of the invention (e.g., the embodiment shown in FIGS. 14A and 14B) includes corner grooves 372 that extend from the top surface 320 along a substantially vertical corner surface defined by the intersection of two side surfaces 340, 342, 344, 346, and toward the bottom surface 330. As may be understood from FIG. 13, in various embodiments, the top surface of the container may include one or more (and substantially 2, 3, or 4) planar (e.g., substantially triangular) surfaces 325 adjacent one or more respective corners of the container. In various embodiments, one or more of these planar surfaces is angled between 40 and 60 degrees (and preferably about 48 degrees) to the horizontal when the container is in an upright position.

Method of Stacking and Shipping the Containers

Various embodiments of the present invention also relate to a method of stacking containers (such as the containers 10, 110 described above), and for assembling and securing stackable containers (e.g., on a pallet) for shipment. In one embodiment of the invention, to stack a group of stackable containers 10, 110, a user first groups stackable containers 10, 110 in pairs of two and then wraps each pair of containers with a flexible material or film, such as shrink wrap. In a preferred embodiment, the two containers 10, 110 are wrapped together in such a way that their corresponding handles 60 are positioned adjacent one another for easier handling. In a particular embodiment of the invention, the handles 60 of the two containers are tied together for additional support. These wrapped pairs of containers are then positioned on a pallet in alternating directions. For example, in one embodiment of the invention, a first pair of containers is positioned so that the central horizontal axis of the pair of containers runs east-west, and so that a second pair of containers is positioned adjacent the first pair of containers so that the central horizontal axis of the two container combination runs north-south. (Alternatively, the containers could be stacked so that they do not alternate in orientation.)

In one embodiment, the alternated positioning of the various sets of containers 10 helps to provide lateral support for containers 10 when the containers 10 are stacked on top of one another. As noted above, in one embodiment of the present invention, various of the container's side surfaces 40, 42, 44, 46 may define corresponding vertical grooves 70 and ridges (not shown). In one embodiment, the containers 10 are positioned so that these corresponding vertical grooves 70 and ridges interlock to provide additional lateral support to the stacks of containers.

Once a first layer of containers 10 has been formed on the pallet (e.g., to have a substantially rectangular footprint), a second layer of containers 10 is stacked on top of the first layer by again grouping pairs of containers together, individually wrapping each pair, and then interlockingly stacking each of the containers 10 on top of a corresponding bottom container within the first layer of containers as discussed above. This process is continued for each of a plurality of layers. In various embodiments, three, four, five, or more layers of stackable containers 10 can be formed on each pallet.

Figures 12A, 12B:
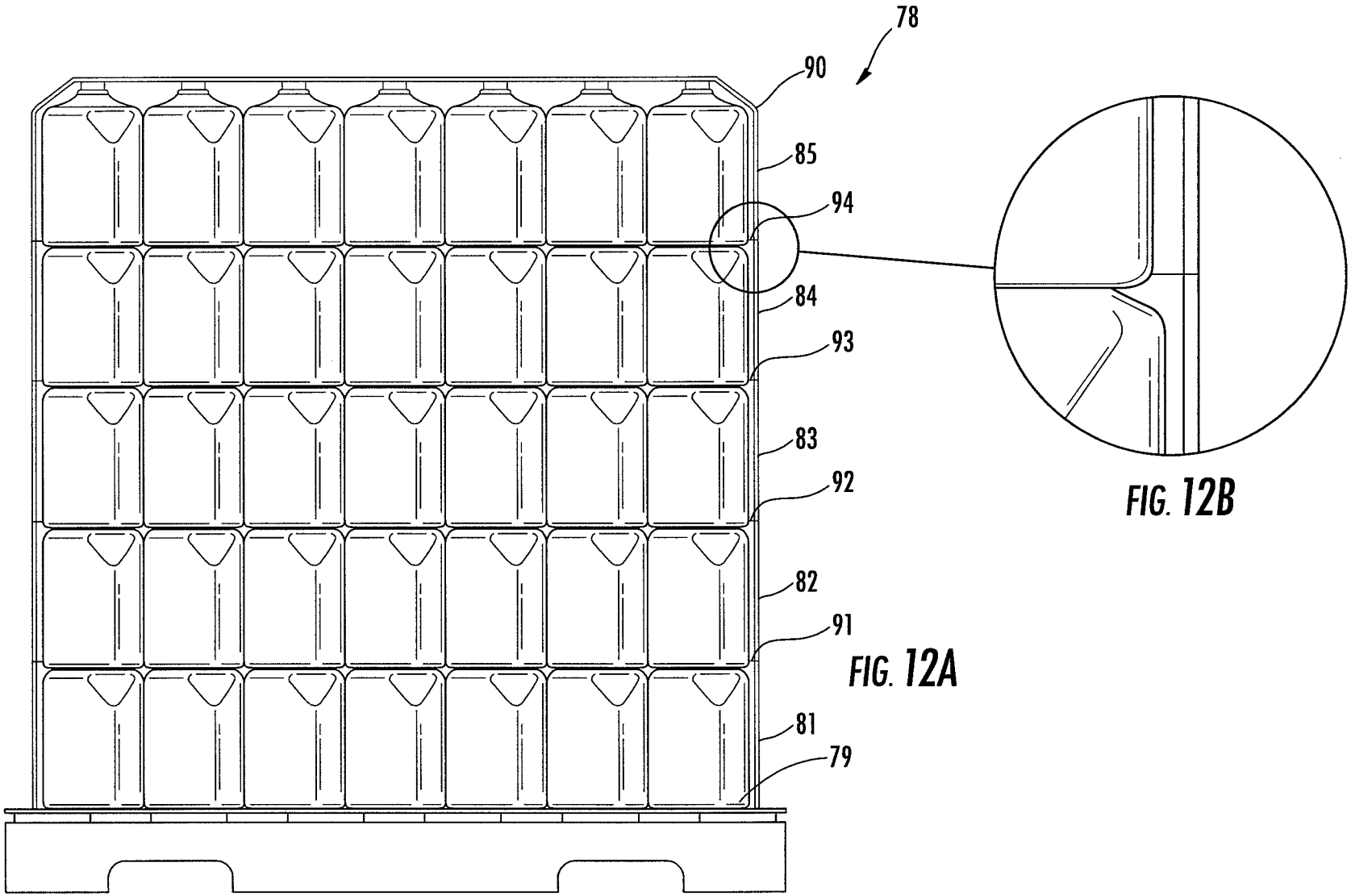
FIG. 12A illustrates stackable containers stacked on a pallet and shrink wrapped in accordance with one embodiment of the present invention.
FIG. 12B is a close-up view of the perforation line on the shrink wrap shown in FIG. 12A.

Once the pallet is full, the various layers of stackable containers 81-85 are covered with shrink wrap 90 (or other suitable protective material, such as cling wrap) so that the protective material substantially covers the side and/or top portions of the stack of containers 78 (see FIGS. 12A and 12B). In one embodiment of the invention, this is done by placing a one-piece bag of shrink wrap 90 over the top of the stack of containers 78 so that the opening 79 of the bag substantially encircles the base of the stack of containers 78 and the body of the bag 90 covers the top and side surfaces of the stack of containers 78. The entire bag-covered stack of containers 78 may then be passed adjacent a heater to shrink the film tightly around the stack of containers 78.

In one embodiment of the present invention, the shrink wrap bag 90 is custom sized and perforated to accommodate the particular stackable containers being shipped. More specifically, as may be understood from FIGS. 12A and 12B, in one embodiment, the bag 90 includes one or more horizontal perforated portions 91-94 that may, for example, extend substantially around the circumference of the stack of containers 78 when the bag 90 is in place adjacent the containers 78. In particular embodiments, one or more of these horizontal perforated portions 91-94 extends adjacent (and preferably entirely around) the vertical position at which two layers of containers 81-85 interface.

In a preferred embodiment, a horizontal perforated portion 91-94 is included adjacent each vertical position at which two layers of containers interface. These rows of perforations 91-94 allow a user (for example, an employee at a retail store receiving a pallet of milk containers) to tear off the shrink wrap at the highest perforation 94 in order to expose only the top layer 85 of stackable containers. In one embodiment, the other layers of stackable containers 81-84 remain covered by the shrink wrap. Once the containers in the highest layer 85 have been removed, a user can detach the current top layer of film at the next highest perforation 93 to expose the next layer of stackable containers 84. This process can be continued until the stackable containers of each layer 81-85 have been removed.

Beveling

As noted above, various portions of the container 10 may be beveled (or chamfered) to provide additional strength to the container 10. For example, in various embodiments of the invention, one or more of the following surfaces of the container 10 are beveled: (1) one or more portions of the perimeter of the container's top surface 20; (2) one or more portions of the container's corner vertical edges; and (3) one or portions of the perimeter of the container's bottom surface 30.

Material Used to Produce the Container

In various embodiments of the present invention, the container 10 may be made, for example, from HDPE, PET, PE, PP, PVC or polycarbonate. However, the container 10 may comprise, or consist of, any other suitable material or combination of materials.

Size and Weight of the Container

While the storage capacity of the stackable container in a particular embodiment of the invention is one gallon, the container's storage capacity may be any suitable amount. For example, in various embodiments of the invention, the container's storage capacity is between about one pint and five gallons.

In one embodiment of the invention, the weight of an empty container is between about 60 and 95 grams. However, the weight of the container may be outside this range in other embodiments of the invention.

Figure 10G:
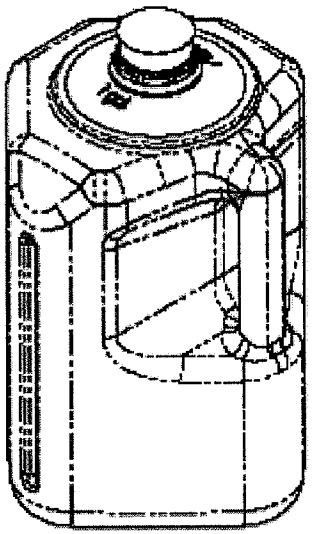
FIG. 10G is a perspective view of the stackable container of FIG. 10A.
Figure 10E:
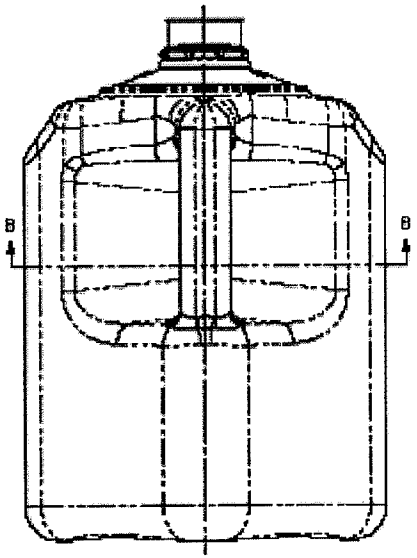
FIG. 10E is a perspective side corner view of the stackable container of FIG. 10A showing the first rear side surface and the second rear side surface of the stackable container.
Figure 10F:
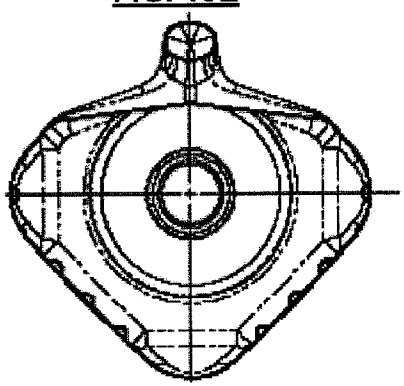
FIG. 10F is a cross-sectional view of the stackable container shown in FIG. 10A taken along section B-B, which is shown in FIG. 10E.
Figure 10B:
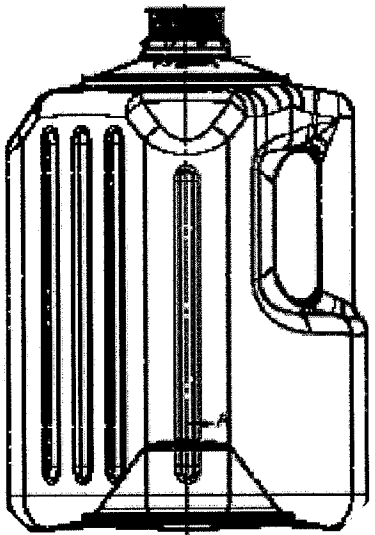
FIG. 10B is a perspective side corner view of the stackable container of FIG. 10A showing the first front side surface and the first rear side surface of the stackable container.
Figure 10D:
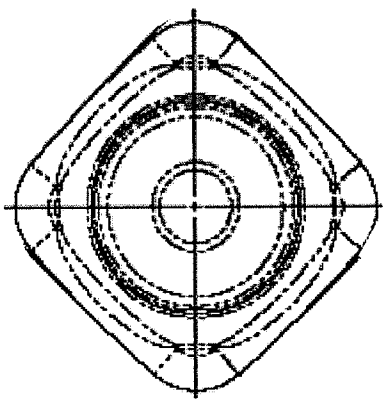
FIG. 10D is a bottom view of the stackable container shown in FIG. 10A.
Figure 10A:
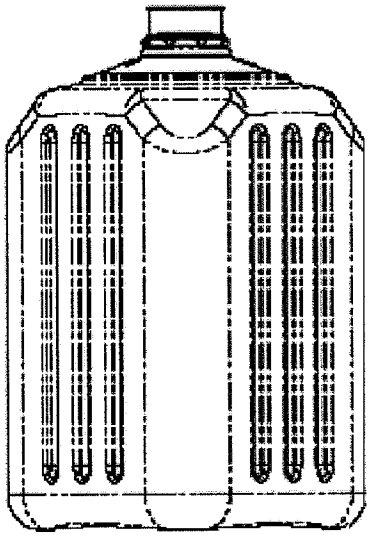
FIG. 10A is a perspective side corner view of a stackable container showing the second front side surface and the second rear side surface of the stackable container in accordance with a particular embodiment of the present invention.
Figure 10C:
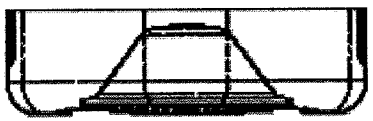
FIG. 10C is a cross-sectional view of the stackable container shown in FIG. 10A taken along section A-A, which is shown in FIG. 10B.
Figure 11B:
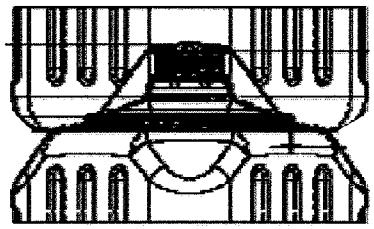
FIG. 11B is a close-up view of the interface between the two stackable containers stacked on top of one another shown in FIG. 11A.
Figure 11A:
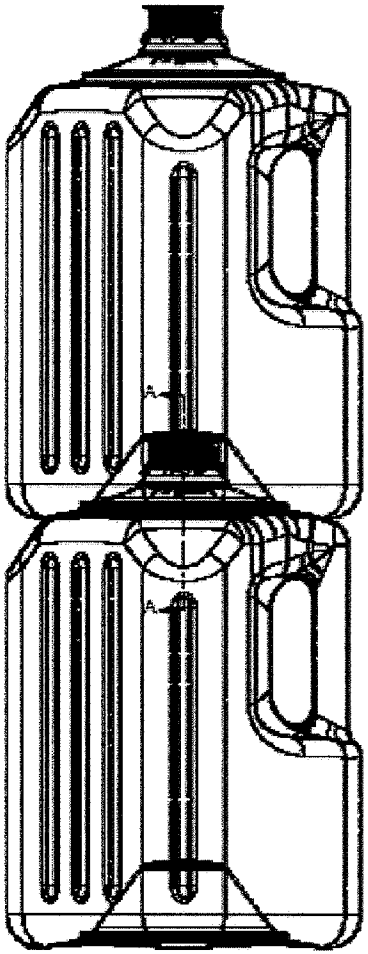
FIG. 11A illustrates a cross-sectional view of two stackable containers stacked on top of one another in accordance with one embodiment of the present invention.
Figure 13:
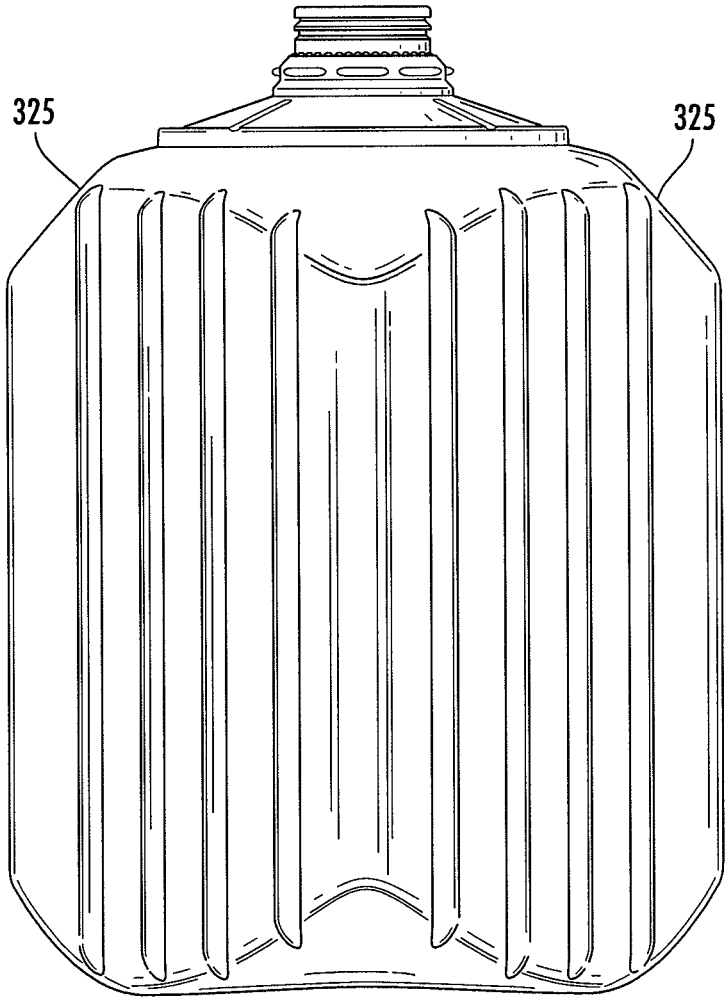
FIG. 13 is a perspective view of a stackable container in accordance with one embodiment of the invention.

Although the container of FIG. 1 is shown as having a generally square horizontal cross section (e.g., base cross section), in various other embodiments of the invention, the container (e.g., the base of the container) may have a horizontal cross section in any other appropriate form. For example, the horizontal cross section of the container's bottom surface may be generally in the form of: a circle (as shown in FIG. 13), a triangle (as shown in FIGS. 10E and 10F), a rounded square (as shown in FIGS. 10A-10D), a hexagon (as shown in FIG. 10G), an octagon (not shown), or an oval (not shown).

Conclusion

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

We claim:

1. A first stackable container configured to be stacked atop or below a second stackable container having substantially the same structure, said first stackable container itself comprising:

a top surface comprising a shoulder portion and a neck portion;

a bottom surface defining a stacking recess, said stacking recess itself including a recessed portion; and a plurality of substantially vertical side surfaces that extend between said top surface and said bottom surface, wherein:

said shoulder portion comprises an interface lip, wherein said shoulder portion, including at least a portion of said interface lip, extends upwardly relative to said bottom surface and away from an interior portion of said first stackable container, wherein said shoulder portion is substantially disposed within a perimeter defined by said top surface, and wherein said interface lip is substantially disposed within a perimeter defined by said shoulder portion;

said stacking recess extends upwardly relative to said bottom surface and toward said interior portion of said first stackable container and wherein said stacking recess is substantially disposed within a perimeter defined by said bottom surface; and said recessed portion is dimensioned to substantially engage with an interface lip of a second stackable container when stacked underneath said first stackable container, said engagement discouraging movement in at least one direction of said recessed portion of said first container relative to said interface lip of said second stackable container, said second stackable container having substantially the same structure, including said interface lip, as said first stackable container.

2. The first stackable container of claim 1, wherein:

said recessed portion is a first recessed portion and further comprises a similarly shaped second recessed portion;

said stacking recess is intermediate said first and second recessed portions, such that said first and second recessed portions are on opposing sides of said stacking recess;

said interface lip is a first interface lip and further comprises a second interface lip;

said neck portion is intermediate said first and second interface lips, such that said first and second interface lips are on opposing sides of said neck portion within said top surface;

said first recessed portion is dimensioned to substantially engage with a first interface lip of said second stackable container; and said second recessed portion is dimensioned to substantially engage with a second interface lip of said second stackable container.

3. The first stackable container of claim 2, wherein said bottom surface further comprises a neck receiving portion, said neck receiving portion dimensioned for receiving at least a portion of said neck portion and disposed intermediate said first and second recessed portions along said bottom surface.

4. The first stackable container of claim 1, wherein said container further includes at least one substantially vertical side groove extending inwardly from at least one of said vertical side surfaces.

5. The first stackable container of claim 4, wherein said vertical side groove is positioned proximate a side corner of the container, said corner defined where two side surfaces meet.

6. The first stackable container of claim 4, wherein said vertical corner side groove extends from said top surface to at least said one of said side surfaces.

7. A first stackable container configured to be stacked atop or below a second stackable container having substantially the same structure, said first stackable container itself comprising:

a top surface comprising a shoulder portion and a neck portion;

a bottom surface defining a stacking recess, said stacking recess itself including a recessed portion; and a plurality of substantially vertical side surfaces that extend between said top surface and said bottom surface, wherein:

said shoulder portion comprises an interface lip, said shoulder portion, including at least a portion of said interface lip, extends upwardly relative to said bottom surface and away from an interior portion of said first stackable container, said shoulder portion is substantially disposed within a perimeter defined by said top surface, and said interface lip is substantially disposed within a perimeter defined by said shoulder portion;

said stacking recess extends upwardly relative to said bottom surface and toward said interior portion of said first stackable container and said stacking recess is substantially disposed within a perimeter defined by said bottom surface; and said recessed portion is dimensioned to substantially engage with an interface lip of a second stackable container when stacked underneath said first stackable container, said engagement discouraging movement in at least one direction of said recessed portion of said first container relative to said interface lip of said second stackable container, said recessed portion further dimensioned to be at least substantially supported by a shoulder portion of said second stackable container, said second stackable container having substantially the same structure, including said interface lip, as said first stackable container.

8. The first stackable container of claim 7, wherein:

said recessed portion is a first recessed portion and further comprises a similarly shaped second recessed portion;

said stacking recess is intermediate said first and second recessed portions, such that said first and second recessed portions are on opposing sides of said stacking recess;

said interface lip is a first interface lip and further comprises a similarly shaped second interface lip;

said neck portion is intermediate said first and second interface lips, such that said first and second interface lips are on opposing sides of said neck portion within said top surface;

said first recessed portion is dimensioned to substantially engage with a first interface lip of said second stackable container; and said second recessed portion is dimensioned to substantially engage with a second interface lip of said second stackable container.

9. The first stackable container of claim 8, wherein said bottom surface further comprises a neck receiving portion, said neck receiving portion dimensioned for receiving at least a portion of said neck portion and disposed intermediate said first and second recessed portions along said bottom surface.

10. The first stackable container of claim 7, wherein said container further includes at least one substantially vertical side groove extending inwardly from at least one of said vertical side surfaces.

11. The first stackable container of claim 10, wherein said vertical side groove is positioned proximate a side corner of the container, said corner defined where two side surfaces meet.

12. The first stackable container of claim 11, wherein said vertical corner side groove extends from said top surface to at least said one of said side surfaces.

13. A first stackable container configured to be stacked atop or below a second stackable container having substantially the same structure, said first stackable container itself comprising:

a top surface comprising a shoulder portion and a neck portion;

a bottom surface defining a stacking recess, said stacking recess itself defining first and second recessed portions, said first and second recessed portions being on opposing sides of said stacking recess; and a plurality of substantially vertical side surfaces that extend between said top surface and said bottom surface, wherein:

said shoulder portion comprises a first interface lip and further comprises a similarly shaped second interface lip, said neck portion being intermediate said first and second interface lips;

said shoulder portion, including at least a portion of said first and second interface lips, extends upwardly relative to said bottom surface and away from an interior portion of said first stackable container, said shoulder portion is substantially disposed within a perimeter defined by said top surface, and said first and second interface lips are substantially disposed within a perimeter defined by said shoulder portion;

said stacking recess extends upwardly relative to said bottom surface and toward said interior portion of said first stackable container, and said stacking recess is substantially disposed within a perimeter defined by said bottom surface;

said first recessed portion is dimensioned to substantially engage with a first interface lip of a second stackable container when stacked underneath said first stackable container, said engagement discouraging movement in at least one direction of said first recessed portion of said first container relative to said first interface lip of said second stackable container, said second stackable container having substantially the same structure, including said first interface lip, as said first stackable container;

said second recessed portion of said bottom surface adjacent to and partially defining said stacking recess is dimensioned to substantially engage with a second interface lip of said second stackable container, said engagement discouraging movement in at least one direction of said second recessed portion of said first container relative to said second interface lip of said second stackable container, said second stackable container having substantially the same structure, including said second interface lip, as said first stackable container; and said first container includes first and second opposing bottom corners defined by an intersection of two of said plurality of substantially vertical side surfaces and said bottom surface, and wherein said bottom surface of said first container defines a first channel recess portion disposed proximate said first bottom corner of said container and a second channel recess portion disposed proximate a second bottom corner of said container, and wherein said first and second channel recess portions lie generally along a channel axis which is substantially orthogonal to an axis including said first and second recessed portions that engage said interface lips.

14. The first stackable container of claim 13, wherein:

said first and second interface lips are separate and in the form of arcs; and said first and second recessed portions are separate and in the form of arcs, the respective arcs of the first and second recessed portions configured to provide cooperating engagement with the respective arcs of the first and second interface lips.

15. The first stackable container of claim 13, wherein said recessed portion of said first stackable container is dimensioned to be at least substantially vertically supported by a shoulder portion of said second stackable container upon vertical stacking of said first and second containers.

16. The first stackable container of claim 15, wherein:

said first and second interface lips are separate and in the form of arcs; and said first and second recessed portions are separate and in the form of arcs, the respective arcs of the first and second recessed portions configured to provide cooperating engagement with the respective arcs of the first and second interface lips.

17. The first stackable container of claim 13, wherein said container further includes at least one elongate substantially vertical side groove extending inwardly from at least one of said vertical side surfaces.

18. The first stackable container of claim 17, wherein said vertical side groove is positioned proximate a side corner of the container, said corner defined where two side surfaces meet.

19. The first stackable container of claim 18, wherein said vertical corner side groove extends from said top surface to at least said one of said side surfaces.

20. The first stackable container of claim 17, wherein:

said first and second interface lips are separate and in the form of arcs; and said first and second recessed portions are separate and in the form of arcs, the respective arcs of the first and second recessed portions configured to provide cooperating engagement with the respective arcs of the first and second interface lips.

* * * * *